United States Patent [19]

McIntosh, Jr. et al.

[11] Patent Number: 4,919,266

[45] Date of Patent: Apr. 24, 1990

[54] CARTON WITH END WALL DISPLAY WINDOW

[75] Inventors: Everett L. McIntosh, Jr., Hamilton; Charles A. Miller, Williamsburg, both of Ohio

[73] Assignee: The C. W. Zumbiel Co., Cincinnati, Ohio

[21] Appl. No.: 362,675

[22] Filed: Jun. 9, 1989

[51] Int. Cl.[5] ..... B65D 75/00

[52] U.S. Cl. ..... 206/434; 206/427; 206/429

[58] Field of Search ..... 206/140, 427, 429, 434; 229/52 BC, 40

[56] References Cited

U.S. PATENT DOCUMENTS

| | | | |
|---|---|---|---|
| 2,738,871 | 3/1956 | Vander Lugt, Jr. | 229/40 |
| 2,751,075 | 6/1956 | Arneson | 229/40 |
| 2,913,105 | 11/1959 | Brunsing | 206/429 |
| 3,294,280 | 12/1966 | Graser | 206/140 |
| 3,451,543 | 6/1969 | Graser | 206/434 |
| 3,463,306 | 8/1969 | Taylor | 206/434 |
| 3,669,342 | 6/1972 | Funkhouser | 206/140 |
| 3,807,624 | 4/1974 | Funkhouser | 229/40 |
| 4,421,232 | 12/1983 | Konaka | 206/434 |
| 4,765,535 | 8/1988 | Michetti | 229/40 |

*Primary Examiner*—David T. Fidei

*Attorney, Agent, or Firm*—Wood, Herron & Evans

[57] ABSTRACT

An end wall display window particularly structured for use with a wraparound type carton in which a container matrix of, e.g., soft drink or beer cans, is sold. The display window structure preferably includes two wrap panels at each end of the carton, one on each wrap panel pair being connected to each of the carton's side walls. The two wrap panels of each pair are wrapped around portions of the outer surface of the end container in the matrix so that the wrap panels conform to the configuration of those container outer surface portions. The wrap panels are configured to define a window so that at least a portion of those end containers about which they are wrapped will be exposed to the sight of a casual viewer.

12 Claims, 3 Drawing Sheets

CARTON WITH END WALL DISPLAY WINDOW

BACKGROUND OF THE INVENTION

This invention relates tocartons. More particularly, this invention relates to a carton with novel end wall structure, and to a carton blank therefor.

In the marketing of soft drinks and beer, it is well known to sell those retail consumer products in cans which are grouped together in matrix configuration, e.g., six cans so the product is sold in so-called six packs. These six pack can matrixes, or matrixes of other numbers, are commonly packaged in cartons so as to make it easier to handle the product for the wholesaler and the retailer, as well the retail consumer.

There are any number of different types of bottle and can carriers and cartons known to the prior art. But one particular type that has found significant commercial success over the years is a so-called wraparound carton. In a wraparound carton, a matrix of a number of containers, e.g., six cans, is wrapped in a paperboard box or carton comprised of top and bottom wall panels, side wall panels, and end flaps on each end. The carton's end flaps at each end are sealed one to the other, thereby providing a closed or sealed package or carton for the cans. Now with the wraparound carton package so formed, all can within the package are hidden from the retaion consumer's view. In other words, the carton's end flaps, as well as the carton's top, bottom and side walls, provide a completely enclosed package until the package is broken open so that the cans can be removed for use. A typical such prior art wraparound carton is shown in U.S. Pat. No. 4,784,316, assigned to the assignee of this invention.

SUMMARY OF THE INVENTION

Accordingly, it has been the primary objective of this invention to provide a container carton, and particularly a container carton of the wraparound type, with end wall structure that defines a display window on at least one end wall of the carton. This display window is sized and configured so that at least a portion of the can's artwork and advertising message is available for view by the retail consumer, and/or so that the can's code is not available for reading by the wholesaler and/or retailer.

In accord with this objective this invention, in preferred form, contemplates a wraparound type carton with display window structure that includes two wrap panels at each end of the carton, one of each wrap panel pair being connected to each of the carton's side walls. The two wrap panels of each pair are wrapped around portions of the outer surface of the end container in the matrix so that the wrap panels conform to the configuration of those container outer surface portions. The wrap panels are configured to define a window so that at least a portion of those end containers about which they are wrapped will be exposed to the sight of a casual viewer.

DESCRIPTION OF THE DRAWINGS

Other objectives and advantages of the invention will be more apparent from the following detailed description taken in conjunction with the drawings in which.

DESCRIPTION OF THE PREFERRED EMBODIMENT

Figure 1:
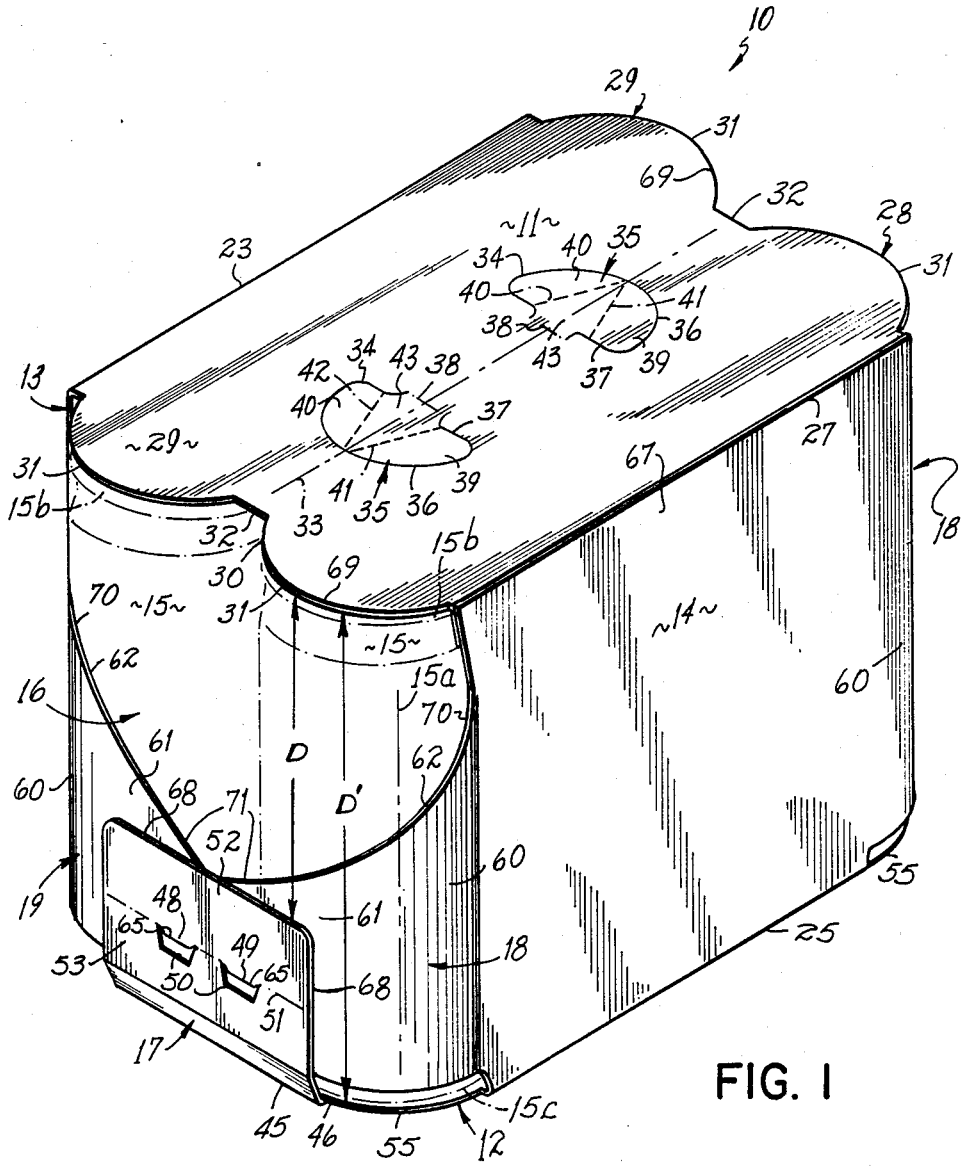
FIG. 1 is a perspective view illustrating a wraparound carton with end wall display window in accord with the principles of this invention.

The wraparound carton 10 of this invention basically includes a top wall 11, bottom wall 12, and opposed side walls 13, 14, all of which are wrapped around a matrix of containers, e.g., six cans 15, and which collectively give rise to the wraparound type carton designation. The carton 10, in accord with the principles of this invention, and as shown in FIG. 1, includes a display window 16 of generally shield-shaped configuration at each end thereof. The display window 16 at each end is defined by an end wall 17, and by two wrap panels 18, 19, the structure of which is described in greater detail below.

Figure 2:
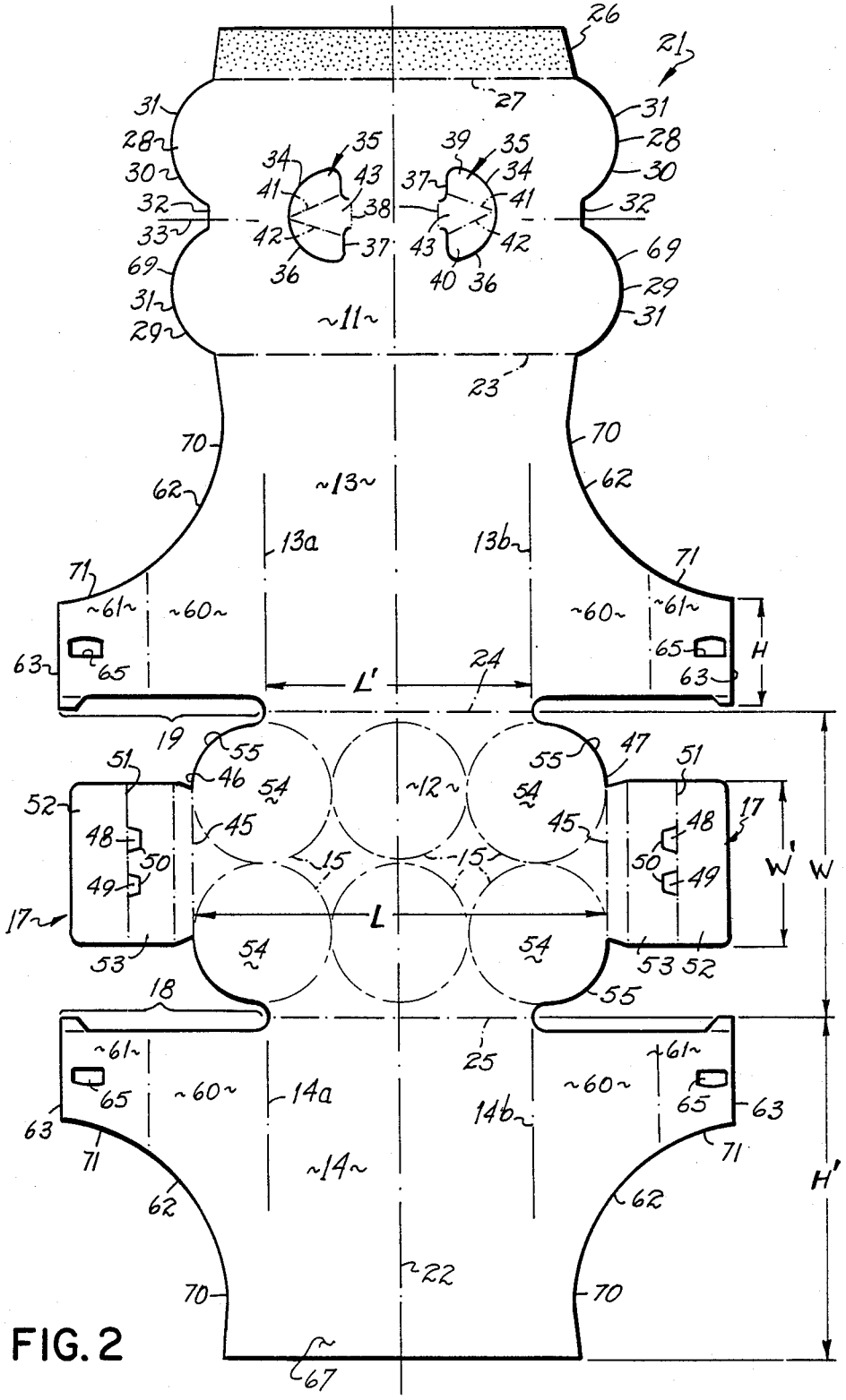
FIG. 2 is a top view of a carton blank from which the FIG. 1 carton is erected.

A carton blank 21 in accord with the principles of this invention is illustrated in FIG. 2. The carton blank 21 includes a top wall 11 panel, a first side wall 13 panel, a bottom wall 12 panel, and a second side wall 14 panel, these panels being arranged in that order along the blank's longitudinal axis 22. The top wall 11 panel is connected on fold line 23 to the top edge of the first side wall 13 panel. The bottom wall 12 panel is connected along one side edge on fold line 24 to the bottom edge of the first side wall 13 panel, and is connected along its other side edge on fold line 25 to the bottom edge of the second side wall 14 panel. A glue flap 26 (having adhesive on its underside as viewed in FIG. 2) is connected on fold line 27 to the free edge of the top wall 11 panel along the entire length of that edge. Note the blank's fold lines 27, 23, 24, 25 are all parallel one to the other.

The top wall 11 panel includes two lobes 28, 29 along each end edge 30 thereof. The lobes 28, 29 at each end are each defined by a curvilinear edge 31 which is of convex configuration, same cooperating to define a throat cutout 32 between. Note the two lobes 28, 29 at each end are symmetrically disposed relative to the top wall 11 panel's longitudinal axis 33. The carton 10 formed from the blank 21 illustrated in FIG. 2 is sized to hold six cans 15 in a three by two matrix configuration. Accordingly, the convex curvilinear edge 31 of each lobe 28 and 29 is a circular arc with a radius generally the same as a can's radius so that the lobe overlies the can's top end, as particularly illustrated in FIG. 1, when the carton is erected and filled.

The top wall 11 panel also includes two finger holes 34 located symetrically on opposite sides of the blank's longitudinal axis 22. Each finger hole 34 includes a breakaway flap 35 defined by cut lines 36, 37, that flap being connected to the top wall 11 panel on fold line 38. Each breakaway flap 35 is comprised of a pair 39, 40 of outer ears connected by fold lines 41, 42, respectively, to a center section 43. When the carton 10 is in the FIG. 1 use configuration, a retail consumer, for example, can punch the breakway flaps 35 downwardly or interiorly into the carton by depressing same generally centrally thereof, the ears 39, 40 folding upwardly to enhance that breakaway action. Thereafter, and with, for example, the user's thumb in one finger hole 34 and the user's second finger in the other finger hole, the FIG. 1 carton of containers can be easily lifted and carried.

Referring again to FIG. 2, each bottom wall 12 panel has an end wall 17 panel connected on fold line 45 along each end edge 46, 47 thereof. Each end wall panel 17 includes two locator tabs 48, 49 defined by cut lines 50. The two locator tabs 48, 49 are connected to the end wall panel on fold line 51 so that when the end wall panel's outer section 52 is folded on that fold line 51 relative to the end wall panel's inner section 53, the locator tabs 48, 49 remain co-planar with the end wall panel's outer section 52, i.e., the locator tabs 48, 49 pop out of the end wall panel's inner section 53. Note particularly the width W of the bottom wall 12 panel is significantly greater than the width W' of each end wall 17 panel. More particularly, it is preferred that each end wall 17 panel be of a width greater than about one-fourth the width W of the bottom wall 12 panel, but less than about three quarters the width of that bottom wall panel 12. Note also the bottom wall 12 panel includes opposed corners 54 which each present an outer edge 55 of a convex curvilinear configuration. The arcuate radius of these curved corners 54 is each generally similar to the radius of a can 15 to be carried within the carton 10, and the arcuate corner edges 55 are each of a length about equal to one-quarter the peripheral length of a can 15, as that can is viewed in cross section normal to the can's longitudinal axis 15*a* at a location midway between the can's head 15*b* and foot 15*c* (as shown in FIG. 1). Note also that the length L of the bottom wall panel is substantially greater than the length L' of the foldable edge 24 or 25 by which each side wall 13 or 14 panel is connected to the bottom wall panel 12.

Side wall 13 panel includes a wrap panel 19 which extends from each phantom side edge 13*a*, 13*b* thereof and side wall 14 panel includes a wrap panel 18 which extends from each phantom side edge 14*a*, 14*b* thereof. The side edges 13*a*, 13*b* and 14*a*, 14*b* of the side wall 13 and 14 panels are not definitive in that the wrap panels 19, 18 meld or merge into those side wall panels 13 and 14 because same are not foldably connected thereto but are simply formed integral therewith. Each panel 18, 19 includes a transition flap 60 and a positioner flap 61, and these two flaps also are formed integral one with another, i.e., are not foldable relative one to the other. However, and since the side wall 13, 14 panels and wrap panels 18, 19 are made of paperboard, same are substantially flexible or curvable as is described in further detail below. Each positioner flap 61 includes a locator hole 65 cut of of that flap. The locator hole 65 cooperates with an analogous locator tab 48 or 49 in the end walls 17 during final assembly of the carton 10 after cans 15 have been placed therein. The top edge 62 of each wrap panel 18, 19 is defined by a concave curvilinear end edge which extends downwardly from the respective side wall panel's 13 and 14 top edge toward the respective side wall panels' bottom edge. This top edge 62 terminates at the wrap panel's outer side edge 63 substantially above the associated side wall panel's bottom edge 24 or 25, thereby defining an outer side edge height H less than one-half the height H' of the associated side wall panel 13 or 14, and preferably less than one-third that height H'.

In the usual course of commercial events, the carton blank 11 will be produced by a carton manufacturer, will be partially assembled, and then will be shipped from the carton manufacturer to a soft drink or beer bottler in a flattened configuration. The partially assembled, and as-shipped attitude of a carton 10 in accord with the principle of this invention is illustrated particularly in FIG. 3. Note in this figure that the top wall 11 panel and second side wall 14 panel are folded on fold lines 23, 25 over side wall 13 panel and bottom wall 12 panel. The glue flap 26 is then adhesively secured to the underside of the side wall 14 panel along its top edge 67 to that glue flap 26 to establish the carton 10 in its shipment configuration. In this shipment configuration, the carton 10 is shipped flat to the bottler.

Figure 3:
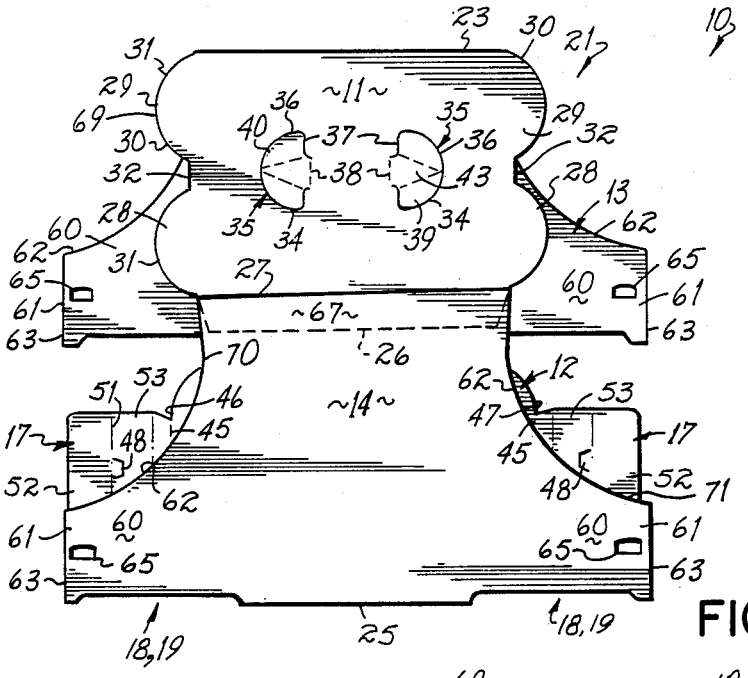
FIG. 3 is a view similar to FIG. 2 illustrating the carton blank in shipment configuration after production by a carton manufacturer but prior to use by a soft drink or beer bottler.
Figure 4:
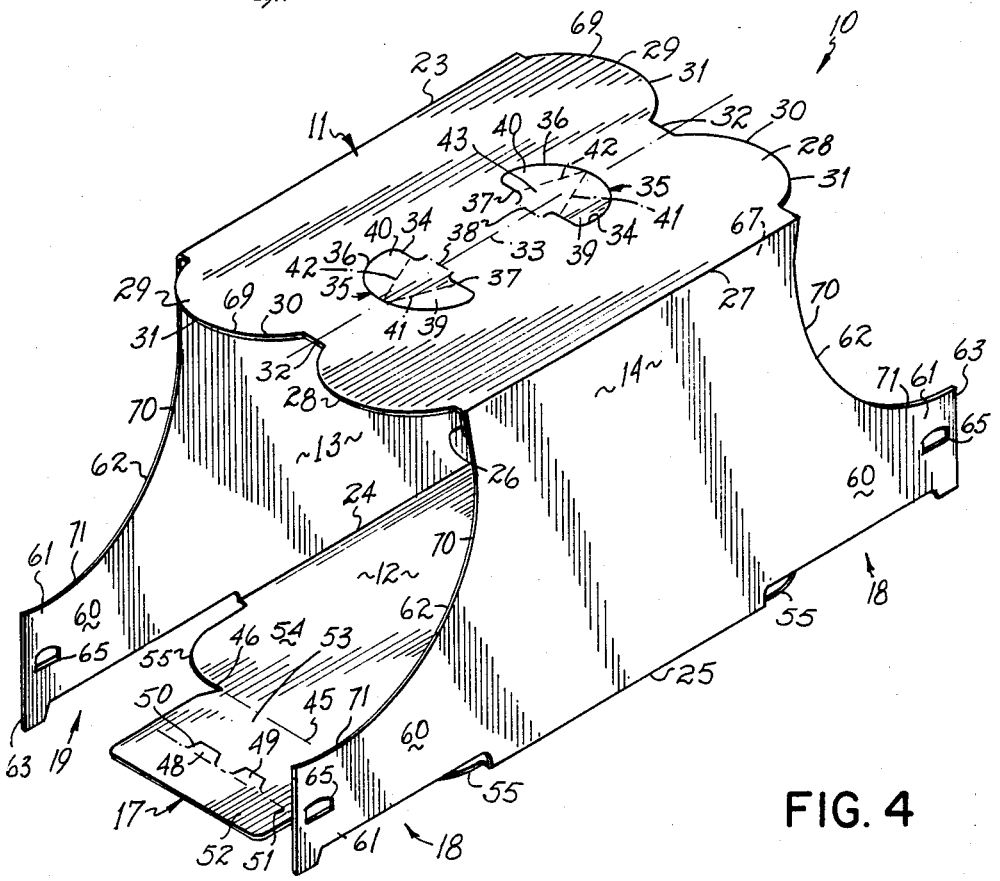
FIG. 4 is a perspective view illustrating final assembly of the carton prior to filling with a six can matrix.

When the flattened carton 10 shown in FIG. 3 reaches the bottler, same is initially erected into a sleeve-like configuration, as shown in FIG. 4, where the carton's end wall 17 panels remain co-planar with the carton's bottom wall 12 panel, and where the carton's wrap panels 19, 18 remain co-planar with the carton's respective side wall 13, 14 panels. In this sleeve-like configuration the carton is then loaded with a six can 15 matrix. Subsequently, and at each carton end 17, the two wrap panels 18, 19 are deformed or wrapped around a portion of the outer surfaces of the associated two end cans 15 and, thereby, conformed to the peripheral configuration to those cans' outer surface portions. In this regard, each of the wrap panels 18, 19 are wrapped around about one-fourth of the periphery of an end can 15 as viewed in cross-section normal to the container's longitudinal axis 15*a* (see FIG. 1). Thereafter, and again at each end, the end wall 17 panel is folded upwardly along fold line 45, and the end wall panel's outer section 52 folded outwardly relative to fold line 51, so that the end wall panel's locator tabs 48, 49 can be inserted into the positioner flaps' locator holes 65, thereby interfitting the end panel's locator tabs with the wrap panels 18, 19 so as to locate and restrain those wrap panels in final carton configuration or position. Thereafter each end wall panel's outer section 52 is glued, as at 68, to its respective wrap panels' positioner flaps 61 for sealing the end wall panels 17 to the wrap panels 18, 19. This presents a final carton 10 structure with cans 15 held securely within the carton's interior as shown in FIG. 1.

The carton 10, now filled with cans, includes a display window 16 formed in each end wall of the carton. This display window 16 includes a top edge 69 defined by the carton's top wall 11, and side 70 and bottom 71 edges which are of a generally curvilinear configuration defined by the top edges 62 of the wrap panels 18, 19. Note particularly that the major height D of this display window opening, when the carbon is viewed from its end along a line of sight parallel to the axis 15*a* of the cans 15, is greater than one-half the height D' of the cans 15, but is of a height less than about three-quarters the height of the cans. Further, the display window 16 so formed is of a generally shield-shaped configuration because of the downwardly extending curvilinear top edges 62 of the wrap panels 18, 19. The end wall 17 structure, therefor, cooperates to provide a can carton 10 of significant structural integrity, yet which exposes a significant portion of the two end cans' outer surfaces at each end of the carton to view by, e.g., a prospective retail consumer.

Having described in detail the preferred embodiment of my invention, what I desire to claim and protect by Letters Patent is:

1. A container carton comprising a bottom wall, two side walls connected to said bottom wall, a top wall connected to both said side walls, said top, bottom and side walls defining a wrap around type carton, and said bottom wall having a width sufficient to support at least two containers being between said side walls at each end of said bottom wall, two wrap panels at one end of said carton, one of said wrap panels being connected to one of said side walls, and the other of said wrap panels being connected to the other of said side walls, each of said wrap panels being wrapped round a portion of the outer surface of a separate end container, an end wall connected to said bottom wall, both of said wrap panels being connected to said end wall, said end wall being of a width greater than about one-fourth the width of said bottom wall but less than about three-fourths the width of said bottom wall, locator structure partially carried by each wrap panel and partially carried by said end wall, said locator structure functioning to locate both said wrap panels and said end wall in final operational relation relative to said side walls and said bottom wall, said locator structure comprising at least one locator hole defined in one of each wrap panel and in said end wall, and at least one locator tab defined in the other of each wrap panel and in said end wall, said locator holes and tabs being interfitted one within the other, said wrap panels being configured to define a window so that at least a portion of those end containers about which they are wrapped are exposed to the sight of a casual viewer, the top edge of said window being defined by said top wall, and the side and bottom edges of said window being defined by said wrap panels, the side and bottom edges of said window being defined by a generally concave curvilinear edge which constitutes the top edge of each wrap panel, same cooperating to establish a window of generally shield-like configuration.

2. A container carton as set forth in claim 1, said carton comprising at least two wrap panels at both ends of said carton, each of said wrap panels being connected to both said side walls, each of said wrap panels being wrapped around a portion of an adjacent end container, and both of said wrap panels cooperating with said side walls to confine said containers interiorly of said carton as it is carried during use.

3. A container carton as set forth in claim 2, each of said two wrap panels being wrapped around about one-fourth of the periphery of that adjacent end container as that container is viewed in cross-section normal to the container's longitudinal axis at a location midway between the container's head and foot.

4. A container as set forth in claim 3, said window being sized and configured to expose at least about one-half the length of an end container.

5. A container carton as set forth in claim 1, said top wall comprising at least two lobes at that end of said top wall where said wrap panels are connected, said lobes having a periphery analogous to the primary cross-sectional periphery of the adjacent end container.

6. A container as set forth in claim 5, each of said lobes being defined by a circular arcuate edge, same cooperating to define a throat therebetween, each circular arcuate edge being of a radius generally the same as a can's radius so that each lobe overlies a can's end.

7. A blank for a container carton, said blank comprising a bottom wall, two side walls connectable to said bottom wall, a top wall connectable to both said side walls, said top, bottom and side walls defining a wrap around type carton when said carton is erected, at least two containers being supportable on said bottom wall between said side walls at each end of said bottom wall when said carton is erected, two wrap panels cooperable with said bottom wall at that one end thereof, one of said wrap panels being connectable to one of said side walls, and the other of said wrap panels being connectable to the other of said side walls when said carton is erected, each of said wrap panels being wrapped around a portion of the outer surface of a separate end container, an end wall connectable to said bottom wall, both of said wrap panels also being connectable to said end wall, said end wall being of a width greater than about one-fourth the width of said bottom wall but less than about three-fourths the width of said bottom wall, locator structure partially carried by each wrap panel and partially carried by said end wall, said locator structure functioning to locate both said wrap panels and said end wall in final operational relation relative to said side walls and said bottom wall when said carton is erected, said locator structure comprising at least one locator hole defined in one of each wrap panel and in said end wall, and at least one locator tab defined in the other of each wrap panel and in said end wall, said locator holes and tabs being interfitted one within the other when said carton is erected, said wrap panels being configured to define a window so that at least a portion of those end containers about which they are wrapped are exposed to the sight of a casual viewer when said carton is erected, the top edge of said window being defined by said top wall, and the side and bottom edges of said window being defined by said wrap panels, the side and bottom edges of said window being defined by a generally concave curvilinear edge which constitutes the top edge of said wrap panel, same cooperating to establish a window of generally shield-like configuration when said carton is erected.

8. A blank as set forth in claim 7, comprising at least two wrap panels cooperable with said bottom wall at both ends of said carton, each of said wrap panels being connectable to both said side walls when said carton is erected, each of said wrap panels being wrapped around a portion of an adjacent end container, and both of said wrap panels cooperating with said side walls to confine said containers interiorly of said carton as it is carried during use.

9. A blank as set forth in claim 8, wherein said carton is erected each of said two wrap panels being wrapped around about one-fourth of the periphery of that adjacent end container as that container is viewed in cross-section normal to the container's longitudinal axis at a location midway between the container's head and foot.

10. A blank as set forth in claim 7, said window being sized and configured to expose at least about one-half the length of an end container when said carton is erected.

11. A blank as set forth in claim 7, said top wall comprising at least two lobes at that end of said top wall where said wrap panels are connectable, said lobes having a periphery analogous to the primary cross-sectional periphery of the adjacent end container.

12. A blank as set forth in claim 11, each of said lobes being defined by a circular arcuate edge, same cooperating to define a throat therebetween, each circular arcuate edge being of a radius generally the same as a can's radius so that each lobe overlies a can's top end.

* * * * *

UNITED STATES PATENT AND TRADEMARK OFFICE

CERTIFICATE OF CORRECTION

PATENT NO. : 4,919,266

DATED : April 24, 1990

INVENTOR(S) : E.L. McIntosh, Jr. et al

It is certified that error appears in the above-identified patent and that said Letters Patent is hereby corrected as shown below:

Column 1, line 6 "to cartons" should be separated into two words

Column 1, line 27 please delete "can" and insert --cans--
Column 1, line 29 please delete "retaion" and insert --retail--

Column 1, line 45 please delete "code" and insert --bar code--

Column 5, line 68 please delete "end" and insert --top end--

Signed and Sealed this

Twenty-second Day of October, 1991

*Attest:*

HARRY F. MANBECK, JR.

*Attesting Officer*

*Commissioner of Patents and Trademarks*